United States Patent [19]

Huang et al.

[11] Patent Number: 4,653,583

[45] Date of Patent: Mar. 31, 1987

[54] OPTIMUM PRODUCTION RATE FOR HORIZONTAL WELLS

[75] Inventors: Wann-Sheng Huang; Alfred Brown; Donald L. Hoyt, all of Houston, Tex.

[73] Assignee: Texaco Inc., White Plains, N.Y.

[21] Appl. No.: 793,830

[22] Filed: Nov. 1, 1985

[51] Int. Cl.[4] ..... E21B 43/24

[52] U.S. Cl. ..... 166/252; 166/272; 166/50

[58] Field of Search ..... 166/252, 272, 273, 274, 166/50, 245

[56] References Cited

U.S. PATENT DOCUMENTS

| | | | |
|---|---|---|---|
| 3,811,503 | 5/1974 | Burnett et al. | 166/252 |
| 3,878,892 | 4/1975 | Allen et al. | 166/267 |
| 4,136,738 | 1/1979 | Haynes, Jr. et al. | 166/273 |
| 4,257,650 | 3/1981 | Allen | 299/2 |
| 4,299,286 | 11/1981 | Alston | 166/274 |
| 4,410,216 | 10/1983 | Allen | 299/2 |
| 4,418,753 | 12/1983 | Morel et al. | 166/273 |
| 4,434,849 | 3/1984 | Allen | 166/252 |
| 4,434,852 | 3/1984 | Morel et al. | 166/273 |
| 4,577,691 | 3/1986 | Huang et al. | 166/50 |

FOREIGN PATENT DOCUMENTS

| | | | |
|---|---|---|---|
| 791463 | 8/1968 | Canada | 166/32 |

*Primary Examiner*—Stephen J. Novosad
*Assistant Examiner*—Bruce M. Kisliuk
*Attorney, Agent, or Firm*—Jack H. Park; Kenneth R. Priem; Harold J. Delhommer

[57] ABSTRACT

The disclosed invention is a method of producing horizontal wells in the most efficient manner at an optimum fluid production rate, which is the maximum rate at which fluids may be produced from a horizontal well while maintaining the downward velocity of formation fluids towards the horizontal well at a velocity which will avoid fingering of the fluids through the formation.

5 Claims, No Drawings

OPTIMUM PRODUCTION RATE FOR HORIZONTAL WELLS

BACKGROUND OF THE INVENTION

The invention process is concerned with enhancing the recovery of oil from underground formations. More particularly, the invention relates to a method for efficiently producing horizontal wells at their optimum rate of production.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells, alone or in combination with standard vertical wells, will soon become a chief method of producing tar sand formations and other highly viscous formations which cannot be efficiently produced by conventional methods because of their high viscosity. Most heavy oil and tar sand formations cannot be economically produced by surface mining techniques because of their formation depth.

Various proposals have been set forth for petroleum recovery with horizontal well schemes. Most have involved steam injection or in situ combustion with horizontal wells serving as both injection wells and producing wells. Steam and combustion processes have been employed to heat the viscous formations to lower the viscosity of the petroleum as well as to provide the driving force to push the hydrocarbons toward a well. Although other forms of enhanced oil recovery such as miscible drive and surfactant processes have been mostly ignored in conjunction with horizontal wells, it is quite possible that horizontal wells will be successful adjuncts to these recovery processes in the future.

The critical velocity concept is described in U.S. Pat. Nos. 3,811,503; 3,878,892; 4,136,738; 4,299,286; 4,418,753; 4,434,852 and Canadian Pat. No. 791,463. U.S. Pat. Nos. 4,257,650 and 4,410,216 discuss horizontal well processes and the critical velocity concept. But these two patents conclude that steam should be injected at rates far above critical velocity in their invention processes because fingering can be tolerated in horizontal well systems.

SUMMARY OF THE INVENTION

The invention process is a method of producing horizontal wells in the most efficient manner at an optimum production rate. The optimum production rate is the maximum rate at which fluids may be produced from a horizontal well while maintaining the downward velocity of fluids to be produced from the formation toward the horizontal well at a velocity which will avoid fingering of the fluids through the formation. Consequently, the invention method involves determining the optimum fluid production rate for a horizontal well which will limit the downward movement of fluids towards the horizontal well to a velocity below critical velocity.

DETAILED DESCRIPTION

To maximize oil production from a formation penetrated by a horizontal well, the rate of fluid production from the horizontal well must be carefully controlled. Controlling the fluid production rate is especially important for horizontal wells since horizontal wells are normally perforated over several hundred feet, a much longer interval than traditional vertical wells. Because of the extensive production interval of a horizontal well, uncontrolled fluid production may be many times higher than a vertical well penetrating the same formation, bringing about a much higher chance of damaging the formation through premature production.

Horizontal wells are designed to be drilled into high oil saturation areas, most particularly formation areas containing viscous crudes. Although it is conceivable that horizontal wells could be employed with many different types of enhanced oil recovery processes including carbon dioxide floods and surfactant floods, most applications have envisioned horizontal wells to be applied concurrently with steam flooding or hot water flooding.

Because steam enters the formation at a high temperature and pressure, there will be a natural tendency for injected steam to rise through the hydrocarbon formation. Thus, areas of high oil saturation will exist between wells which are substantially vertical. These areas of high oil saturation are desirable locations to drill horizontal wells for the practice of the invention.

An optimum production rate can be achieved by controlling the rate of fluid production of a horizontal well so that the downward velocity of fluids towards the horizontal well is maintained below its critical velocity. The present invention is directed towards determining the optimum rate of fluid production from a horizontal well and controlling fluid production such that production does not exceed the optimum fluid production rate and cause fluid to move through the reservoir at a speed equal to or faster than critical velocity.

If the production rate of the horizontal well is too high, premature steam breakthrough at the horizontal well or a steam coning situation will occur. Thus, the invention process determines the optimum fluid production rate Q from the equation $$Q = \frac{2\pi r h V_c \phi (1 - S_{or} - S_{wir})}{5.6146\, B_o}$$

where

- Q=optimum fluid production rate in stock tank barrels of fluid per day,
- r=vertical distance between the horizontal well and the fluid medium in feet,
- h=perforated length of the horizontal well in feet,
- $V_c$=critical velocity in feet per day,
- $B_o$=oil formation volume factor in reservoir barrel of oil per stock tank barrel of oil,
- $\phi$=porosity of the formation in fraction,
- $S_{or}$=residual oil saturation in fraction, and
- $S_{wir}$=irreducible water saturation in fraction.

The critical velocity of the flooding medium at its interface with the high oil saturation zone can be estimated by the critical velocity equation $$V_c = \frac{2.741 k_o \Delta\rho}{\phi \Delta\mu (1 - S_{or} - S_{wir})}$$

where

- $V_c$=critical velocity in ft/day,
- $k_o$=oil permeability in darcies, $\Delta\rho$=density difference between the underground hydrocarbons and the fluid medium in g/cc, $\Delta\rho$=viscosity difference between the underground hydrocarbons and the fluid medium in cP, $S_{or}$=residual oil saturation in fraction, $S_{wir}$=irreducible water saturation in fraction, and $\phi$=porosity of the formation in fraction.

Where there is no significant mobile water saturation, both the critical velocity and fluid production rate equations can be simplified. In such a case the term $(1-S_{or}-S_{wir})=\Delta S_o$, where $\Delta S_o$ equals the oil saturation difference between the portion of the formation swept by the fluid medium and the portion of the formation to be swept by the fluid medium in fraction. Most steam flooded formations, however, have a mobile water saturation caused by condensing steam moving downward in the formation.

The present invention of determining the optimum fluid production rate of horizontal wells and limiting production to that optimum production rate is not restricted solely to steam flooded reservoirs. The invention is applicable to all manner of fluid mediums including steam, water, hydrocarbon solvent, carbon dioxide, nitrogen, surfactant systems, chemical systems, or other fluid medium floods.

The diameter and length of the horizontal well and its perforation interval is not critical, except that it will affect the calculations of optimum fluid production rate to be determined for a formation and a horizontal well. Such decisions should be determined by conventional drilling criteria, the characteristics of the specific formation, the economics of a given situation and the well known art of drilling horizontal wells. Such horizontal wells must extend from the surface and run a substantially horizontal distance within the hydrocarbon formation. The optimum number of horizontal wells and their distance from each other and other vertical wells is a balance of economics criteria. Perforation size will be a function of other factors such as flow rate, temperatures and pressures employed in a given operation. Preferably, the horizontal well will be extended into the formation at a position near the bottom of the formation such as the lower third of the formation.

The following example will further illustrate the novel invention of determining and limiting optimum fluid production rate for horizontal wells in order to achieve maximum production. This example is given by way of illustration and not as a limitation on the scope of the invention. Thus, it should be understood that the steps of the present invention may be varied to achieve similar results within the scope of the invention.

EXAMPLE

The reservoir properties used in this Example are typical of a California heavy oil reservoir with unconsolidated sand. A dead oil with an API gravity of about 13° was used for this Example. The Example assumes no mobile water saturation. Other values used in the Example are:

permeability of reservoir=3 darcies, relative permeability of oil=0.3, density difference between oil and steam=0.9 grams per cc, viscosity difference between oil and steam=100 cP, oil saturation difference between the steam zone and the oil zone=0.5, and porosity=0.3.

Using the above properties gives a critical velocity equation of $$V_c = \frac{2.741 k_o \Delta\rho}{\phi \Delta\mu \Delta S_o} = \frac{2.741 \times 3 \times 0.9}{0.3 \times 100 \times 0.5}$$

$$= 0.49 \text{ ft/day.}$$

The optimum fluid production rate for a particular well is a function of several constants such as the perforated length of the horizontal well and the oil formation volume factor and a function of the variable r, the distance from the horizontal well to the steam zone and oil zone interface. When the distance between the horizontal well and the interface between the steam and oil zones=40 feet, the perforated length of the horizontal well=300 feet and the oil formation volume factor=1 reservoir barrel per stock tank barrel, the optimum fluid production rate equation is:

$$Q = \frac{2\pi r h V_c \phi \Delta S_o}{5.6146\, B_o}$$

$$= \frac{2\pi \times 40 \times 300 \times 0.49 \times 0.3 \times 0.5}{5.6146 \times 1}$$

$$= 987 \text{ barrels/day.}$$

The maximum lifting rate to avoid steam coning and premature production will decrease substantially as the distance from the horizontal well to the steam zone decreases. Using the same values as above, the maximum lifting rate or optimum fluid production rate Q decreases to 740 barrels per day when the distance from the horizontal well to the steam zone decreases to 30 feet. When the distance to the steam zone is only 20 feet, the optimum fluid production rate further decreases to 493 barrels of fluid per day. Thus, as the flood progresses, production from horizontal wells must decrease in order to obtain maximum reservoir production.

This example illustrates the advantage of a horizontal well having a long length and also illustrates that one must observe a limit to the producing rate to avoid steam coning and premature production which can destroy the advantages of horizontal wells. The fluid rate and horizontal wells must be monitored and adjusted accordingly as the flood front progresses through the formation towards the horizontal well.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. In a method for enhancing the recovery of hydrocarbons by sweeping an underground hydrocarbon formation with a fluid medium, said formation being penetrated by at least one horizontal producing well, a portion of the horizontal producing well lying in a substantially horizontal position within the formation, wherein the improvement comprises:

determining an optimum fluid production rate for the producing horizontal well which will limit the downward movement of the fluid medium towards the horizontal well to a velocity below a critical velocity to avoid fingering of the fluid medium through the formation, said critical velocity defined as $$V_c = \frac{2.741 k_o \Delta\rho}{\phi \Delta\mu (1 - S_{or} - S_{wir})}$$

where $v_c$=critical velocity in ft/day, $k_o$=oil permeability in darcies, $\Delta\rho$=density difference between the underground hydrocarbons and the fluid medium in g/cc, $\Delta\mu$=viscosity difference between the underground hydrocarbons and the fluid medium in cP, $S_{or}$=residual oil saturation in fraction, $S_{wir}$=irreducible water saturation in fraction, $\phi$=porosity of the formation in fraction, said optimum fluid production rate defined as $$Q = \frac{2\pi r h V_c \phi (1 - S_{or} - S_{wir})}{5.6146\, B_o}$$

where

Q=optimum fluid production rate in stock tank barrels of fluid per day, r=vertical distance between the horizontal well and the fluid medium in feet, h=perforated length of the horizontal well in feet, $v_c$=critical velocity in feet per day, $B_o$=oil formation volume factor in reservoir barrel of oil per stock tank barrel of oil, $\phi$=porosity of the formation in fraction, $S_{or}$=residual oil saturation in fraction, $S_{wir}$=irreducible water saturation in fraction; and limiting the fluid produced from the horizontal well to a rate equal to or less than the optimum fluid production rate.

2. The method of claim 1, wherein the horizontal well is drilled through the lower third of the formation.

3. The method of claim 1, wherein the fluid medium is steam, water, hydrocarbon solvent, carbon dioxide, nitrogen, a surfactant system, or a chemical system.

4. The method of claim 1, wherein the horizontal well is drilled through an area of high oil saturation between wells which are substantially vertical.

5. In a method for enhancing the recovery of hydrocarbons by sweeping an underground hydrocarbon formation with steam, said formation being penetrated by at least two substantially vertical wells and at least one horizontal producing well, a portion of the horizontal producing well lying in a substantially horizontal position within the formation substantially between the two vertical wells, wherein the improvement comprises:

determining an optimum fluid production rate for the producing horizontal well which will limit the downward movement of the steam towards the horizontal well to a velocity below a critical velocity to avoid fingering of the steam through the formation;

said critical velocity defined as $$V_c = \frac{2.741 k_o \Delta\rho}{\phi \Delta\mu (1 - S_{or} - S_{wir})}$$

where $V_c$=critical velocity in ft/day, $k_o$=oil permeability in darcies, $\Delta\rho$=density difference between the underground hydrocarbons and the fluid medium in g/cc, $\Delta\mu$=viscosity difference between the underground hydrocarbons and the fluid medium in cP, $S_{or}$=residual oil saturation in fraction, $S_{wir}$=irreducible water saturation in fraction, $\phi$=porosity of the formation in fraction, said optimum fluid production rate defined as $$Q = \frac{2\, r h V_c \phi (1 - S_{or} - S_{wir})}{5.6146\, B_o}$$

where

Q=optimum fluid production rate in stock tank barrels of fluid per day, r=vertical distance between the horizontal well and the fluid medium in feet, h=perforated length of the horizontal well in feet, $V_c$=critical velocity in feet per day, $B_o$=oil formation volume factor in reservoir barrel of oil per stock tank barrel of oil, $\phi$=porosity of the formation in fraction, $S_{or}$=residual oil saturation in fraction, $S_{wir}$=irreducible water saturation in fraction; and limiting the fluid produced from the horizontal well to a rate equal to or less than the optimum fluid production rate.

* * * * *